US006888507B2

(12) United States Patent
McKim

(10) Patent No.: US 6,888,507 B2
(45) Date of Patent: May 3, 2005

(54) SPLIT LEAD ANTENNA SYSTEM

(76) Inventor: Michael McKim, P.O. Box 14317, Seattle, WA (US) 98114

( * ) Notice: Subject to any disclaimer, the term of this patent is extended or adjusted under 35 U.S.C. 154(b) by 0 days.

(21) Appl. No.: 10/405,893

(22) Filed: Apr. 1, 2003

(65) Prior Publication Data

US 2004/0032372 A1 Feb. 19, 2004

Related U.S. Application Data

(60) Provisional application No. 60/404,062, filed on Aug. 16, 2002.

(51) Int. Cl.[7] ..... H01Q 1/34
(52) U.S. Cl. ..... 343/709
(58) Field of Search ..... 393/709, 791, 393/792, 702

(56) References Cited

U.S. PATENT DOCUMENTS 4,482,333 A * 11/1984 Geri et al. ..... 441/30
5,111,212 A 5/1992 DeSatnick et al. ..... 343/709
5,489,911 A * 2/1996 Gordon et al. ..... 343/709
5,905,467 A * 5/1999 Narayanaswamy et al. . 343/702
6,057,804 A * 5/2000 Kaegebein ..... 343/792
6,384,696 B1 * 5/2002 Miller et al. ..... 333/132

FOREIGN PATENT DOCUMENTS

| | | |
|---|---|---|
| FR | 2223847 | of 1974 |
| NL | 8105622 | of 1983 |

* cited by examiner

*Primary Examiner*—Don Wong
*Assistant Examiner*—Huedung X. Cao
(74) *Attorney, Agent, or Firm*—David Jaffer; Pillsbury Winthrop LLP

(57) ABSTRACT

An antenna assembly for mounting on a backstay of a sailboat. An insulative support apparatus includes a slotted center tube that can be forced over the backstay for mounting thereon. First and second outer tubes are attached on opposite sides of the center tube for holding first and second elongated radiators. Proximal ends of the radiators are electrically joined together and to a lead in-wire for connection to a receiver and/or transmitter. Distal ends of the radiators are secured at distal ends of the outer tubes by attachment to eyelets on the bottoms of plugs inserted into the distal ends of the outer tubes, which serve additionally to prevent water from entering the tubes. The outer tubes each include a water drainage channel to allow moisture accumulating to run out a bottom, proximal end of each tube.

19 Claims, 6 Drawing Sheets

FIG. 2C
FIG. 2D
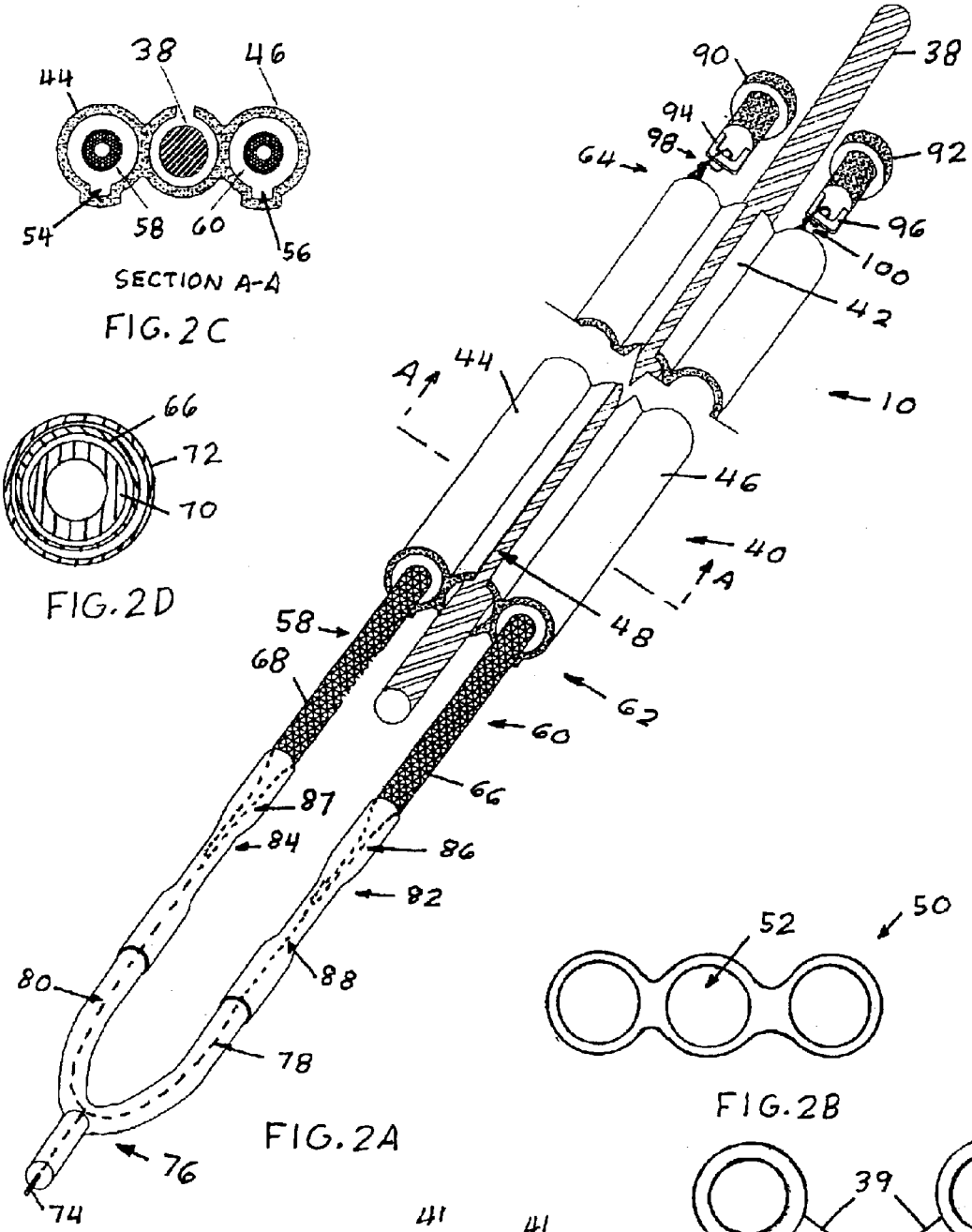
FIG. 2A
FIG. 2B
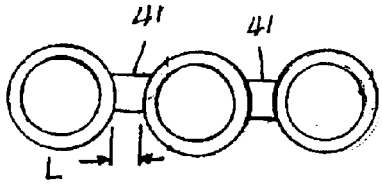
FIG 2F
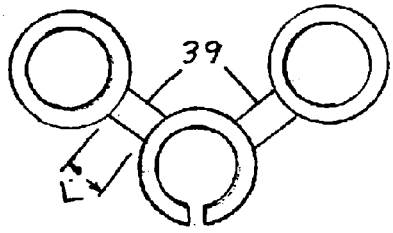
FIG. 2E

SPLIT LEAD ANTENNA SYSTEM

This application claims priority from U.S. Provisional Application Ser. No. 60/404,062 filed Aug. 16, 2002.

BACKGROUND OF THE INVENTION

1. Field of the Invention

The present invention relates generally to antennas for receiving and/or sending electromagnetic energy, and more particularly to a split lead antenna for transmitting and receiving MF/HF radio signals aboard a vessel at sea that mounts on an electrically conductive backstay used in the support of a sailing boat mast.

2. Description of the Prior Art

A common antenna used on a sailboat includes a quarter wavelength whip mounted on top of the sailboat's mast. The antenna in such an installation is difficult to access for service. U.S. Pat. No. 5,489,911 describes a dipole antenna mounted to a sailboat mast backstay. An elongated flexible plastic extrusion has a "C" shaped first channel that is forced over the backstay. A second channel parallel to the first channel is used to insert a dipole antenna that lies parallel to the backstay. Other antenna configurations supported by, but exterior to the extrusion, are also described. French Patent 2,223,847 by Boulch describes an antenna in the form of a length of conductive tube to which a backstay is passed. Electrical insulators are used between the tube and the backstay.

Another common method of constructing an antenna is to make the antenna part of the backstay. Electrical insulators are attached at each end of the antenna length, which are then connected to additional backstay lengths to complete the required backstay length. A problem with this antenna is that the insulators are relatively fragile compared with the additional lengths, and if they break, the mast is left without backstay support.

SUMMARY

It is an object of the present invention to provide an improved antenna for mounting on a conductive backstay of a sailboat.

It is a further object of the present invention to provide a split lead antenna assembly that can be press fit onto a sailboat backstay.

It is another object of the present invention to provide a split lead antenna assembly providing parallel radiators on either side of a conductive backstay when the assembly is mounted thereon.

Briefly, an embodiment of the present invention includes an antenna assembly for mounting on a backstay of a sailboat. An insulative support apparatus is provided including a slotted center tube that can be forced over the backstay for mounting thereon. First and second outer tubes are attached parallel to and on opposite sides of the center tube for holding juxtaposed first and second elongated radiators. Proximal ends of the radiators are connected to a lead-in wire for connection to a common electrical point of a receiver and/or transmitter. Distal ends of the radiators are secured at distal ends of the outer tubes by attachment to eyelets on the bottom of plugs inserted into the distal ends of the outer tubes, with the plugs serving additionally to prevent water from entering the tubes.

IN THE DRAWING

FIG. 2A shows details of the split lead antenna mounted on a backstay;

FIG. 2B illustrates a support apparatus with a non-slotted center tube;

FIG. 2C is a cross-sectional view A—A of FIG. 2B showing a support apparatus, radiators and backstay;

FIG. 2D is a detailed cross-sectional view illustrating the construction of a radiator;

FIG. 2E shows a support structure with a center tube for attaching to a backstay displaced from the plane of outer tubes containing the radiators;

FIG. 2F shows a support structure with tubes spaced apart with struts;

DETAILED DESCRIPTION OF THE PREFERRED EMBODIMENT

Figure 1:
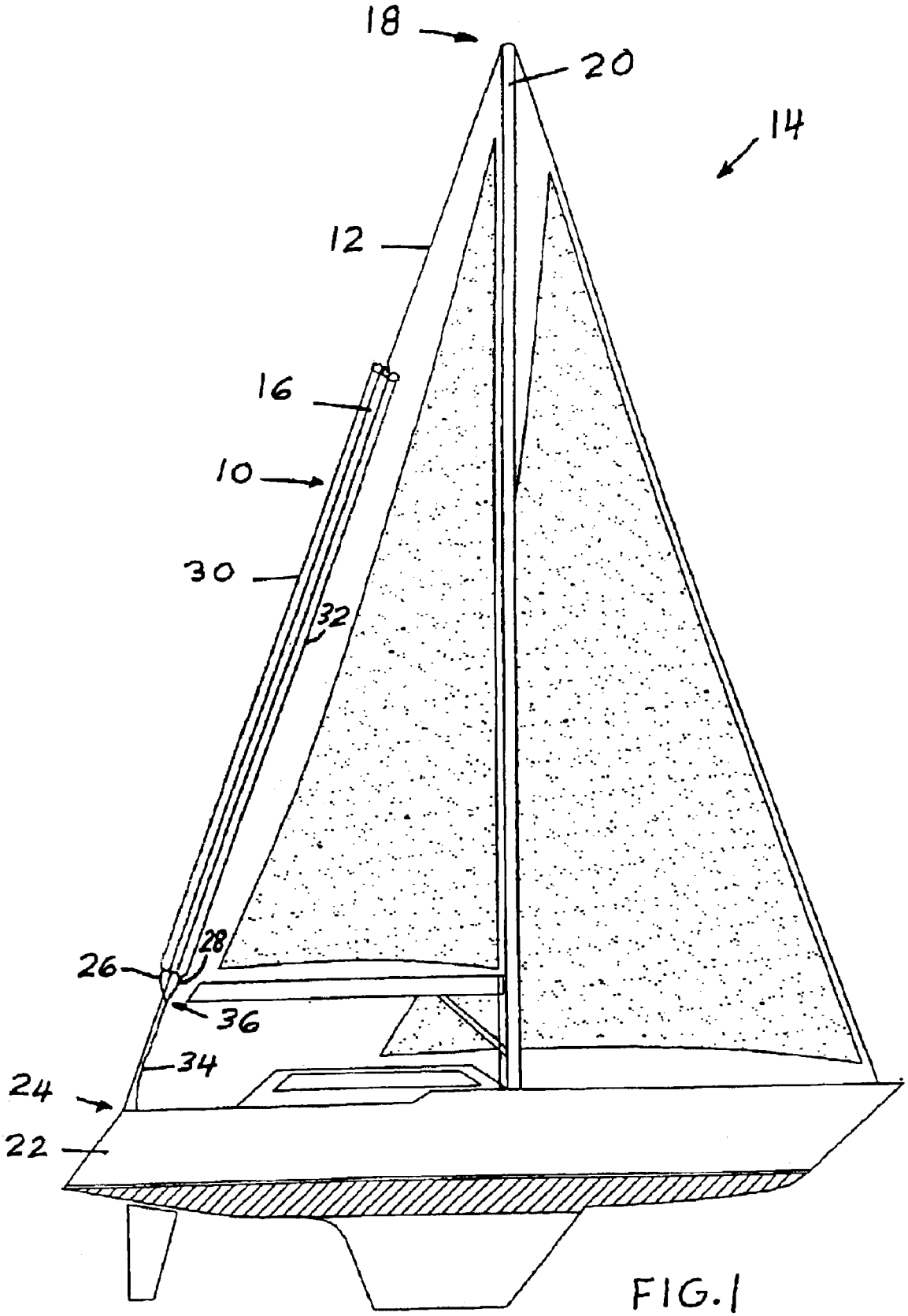
FIG. 1 illustrates the split lead antenna of the present invention mounted on a backstay of a sailboat.

FIG. 1 of the drawing illustrates a split lead antenna assembly 10 according to the present invention, installed on a conductive backstay 12 of a sailboat 14. The assembly 10 includes a three channel support apparatus 40, with an insulative center tube 16 and two outer tubes 30 and 32. The backstay 12 extends through the center tube 16 and is secured at or near the top 18 of the mast 20, and runs continuously from the point of securing 18, through the tube 16, and down to the boat body 22 to which the backstay is secured at some point illustrated symbolically as point 24. In one embodiment, a first radiator apparatus 26 is positioned in an outer tube 30, lying substantially parallel to the center tube 16. A second radiator apparatus 28 is positioned in outer tube 32, also lying parallel to the center tube 16, and spaced substantially 180° around the center tube 16 from the first radiator 26. The first and second radiator apparatus contain elements constructed of conductive material. The conductive elements of the first and second radiator apparatus are joined electrically together at a proximal end of the antenna assembly 10, and are also connected to a lead-in wire of a cable 34 at a point 36. This connection can either be permanent, or through a connector. The cable 34 is run to a transmitter and/or receiver (not shown), which for example could be in the body 22 of the sailboat 14.

One embodiment of the split lead antenna assembly 10 of FIG. 1 is shown in greater detail in FIG. 2A mounted on a backstay 38. A three-channel support apparatus 40 is shown to include a center tube 42, and first and second outer tubes 44 and 46 attached to and spaced apart by the center tube 42. The center tube 42 as shown in FIG. 2A has a slot 48 running the entire length of the tube 42 for the purpose of allowing a backstay 38 to be forced through the slot 48 to the inside of the tube 42 as shown for securing the antenna 10 to the backstay 38. A function of the outer tubes 44 and 46 is to contain and position radiator apparatus 58 and 60 spaced apart on either side of a backstay 38. Other methods of securing two parallel radiator apparatus to a backstay are also included in the spirit of the present invention. For example, FIG. 2B shows a three channel/tube support apparatus 50 without the center slot 48. This configuration requires one end of the backstay to be disconnected to run the backstay through the center tube channel 52. Although the figures of the drawing show the backstay and outer tubes all lying in a common plane, the present invention also includes the backstay displaced above or below the plane defined by the first and second radiators, with the backstay substantially equidistant from each radiator, as shown in FIG. 2E. The three tubes can also be separated by any of various types of supports, such as struts 39 and 41 shown in the end views of FIGS. 2E and 2F. The struts can extend the entire length of the tubes, or they can be spaced apart segments. The struts can be of any desired length "L", depending on the required/desired spacing L between the tubes.

FIG. 2C is a sectional view A—A of the split lead antenna 10 of FIG. 2A, illustrating the inclusion of water drain channels 54 and 56 in the outer tubes 44 and 46, allowing water to drain more readily from the tubes 44 and 46.

Radiator apparatus 58 and 60 extend substantially through the outer tubes 44 and 46 from a proximal end 62 to a distal end 64 of the assembly 10. Referring to FIG. 2D in reference to radiator apparatus 60 for example, the radiator apparatus has a conductive element 66, shown as braided wire, supported by an insulative hollow-tube 70. An outer insulator sleeve 72 is shown covering the conductive element 66. For example, the hollow tube 70 can be a plastic tube of polyethylene (HDPE) with an inner diameter of ⅛" and an outer diameter of ¼". The outer sleeve can be a 1/64" thick HDPE jacket, factory extruded over the metal braid conductor 66 to prevent water ingress and corrosion. The radiator apparatus as specifically described in FIG. 2D is designed to take advantage of an RF phenomenon called the "skin effect," which is the tendency of RF energy to travel only along the surface of a conductor. This means that any conductor is essentially "hollow" from an RF point of view. The hollow conductors minimize weight and cost without reducing RF performance. High-density polyethylene is specified for both the center tube 66 and outer jacket 72 of the RF radiator apparatus for a number of reasons including:

1. HDPE is an outstanding electrical insulator.
2. HDPE presents a smooth "bearing surface," allowing the RF radiator apparatus 58 and 60 to slide easily into the outer tubes 44 and 46 of the split-lead tube arrangement.
3. HDPE provides an ideal combination of both stiffness and flexibility, so that it can be easily coiled for shipment and stowage, but also straightened for insertion into the split-lead tube.
4. HDPE is approximately 30% lighter than PVC and is about the same cost to extrude in production quantities.

A variety of metal braid constructions can be specified for the RF radiator apparatus, depending upon how much current flow is expected to occur along them. One embodiment has a braid construction of 36 gauge copper wire, coated with silver to a minimum coverage of 85%, braided into a tubular arrangement consisting of 24 strands with a total of 7 wires per strand. Current carrying capacity is rated at 32 AC amps, which greatly exceeds the current-carrying requirements of sailboat HF antenna systems. This 36×24×7 braid arrangement minimizes cost and weight. In addition, the fine gauge wires in this braid present a large total surface area for the RF current to travel upon, in a fashion similar to Litz or magnet wire.

Referring again to FIG. 2A, the conductive elements 66 and 68 of the two radiator apparatus 58 and 60 are electrically connected together and also to a lead wire 74 substantially at a proximal end of the antenna assembly 10. This connection of the two conductive elements 66 and 68 to the lead-in wire 74 can be accomplished in any of a variety of ways that will be apparent to those skilled in the art, and these are to be included in the spirit of the present invention. FIG. 2A illustrates a three way junction 76 joining the lead wire 74 to two wires 78 and 80, which are then joined to conductors 66 and 68 respectively through use of electrical splices 82 and 84. In order to connect to the splices 82 and 84, the sleeve 72 and hollow tube 70 of each radiator are cut back a distance, and the resulting unsupported wire braid conductors 66 and 68 are twisted and/or pulled to form smaller, compact conductors, illustrated for example by dashed lines 86 and 87 and inserted in the splices 82 and 84, into inner, metallic sleeve (not shown) portions of the splices. The splices are then crimped to secure the compacted conductors to the sleeves. A similar procedure is used to secure the lead wire 78 at 88 in a corresponding portion of the metallic sleeve, completing the connection between the conductor 66 and wire 78. This procedure is then used to secure the conductor 68 to wire 80 through splice 84.

Figure 3:
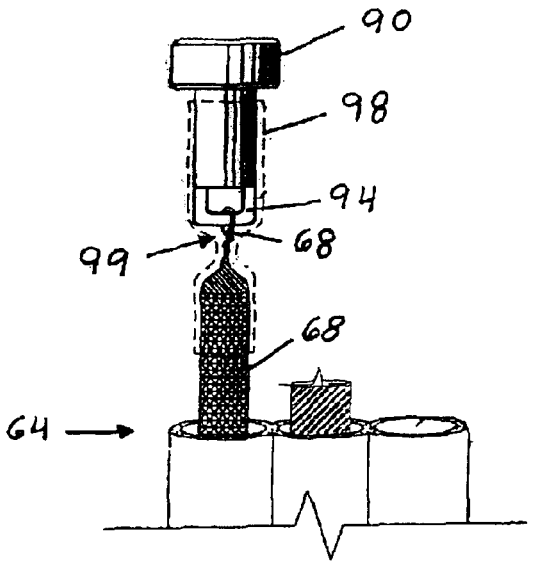
FIG. 3 illustrates the attachment of the distal end of a radiator to a plug.

At the distal end 64 of the antenna 10, plugs 90 and 92 are inserted into tubes 44 and 46 respectively. The plugs serve at least two functions. One function is to seal the top of the tubes 44 and 46 to prevent entry of water. This is achieved by applying a sealing adhesive to the mating surfaces and then inserting the plugs in the tubes. Another function of the plugs 90 and 92 is to secure the distal ends of the radiator apparatus 58 and 60. This is done by cutting back a length, for example of the outer sleeve 72 and hollow tube 70, and then compacting the braided conductive elements, and wrapping each around the corresponding eyelet 94 or 96 as at 98 and 100 to secure each radiator apparatus to the corresponding plug. The details of attachment between a radiator and plug are more clearly shown in FIG. 3 using the conductive element 68 and plug 90 for example. After looping the braided, compacted conductive element through the eyelet 94, the resultant braided loop can be soldered to itself, or the connection can be secured by other methods such as through use of an adhesive, or any or all of these with or without a shrink tube 99 collapsed over the connection to further secure it in place.

Figure 4:
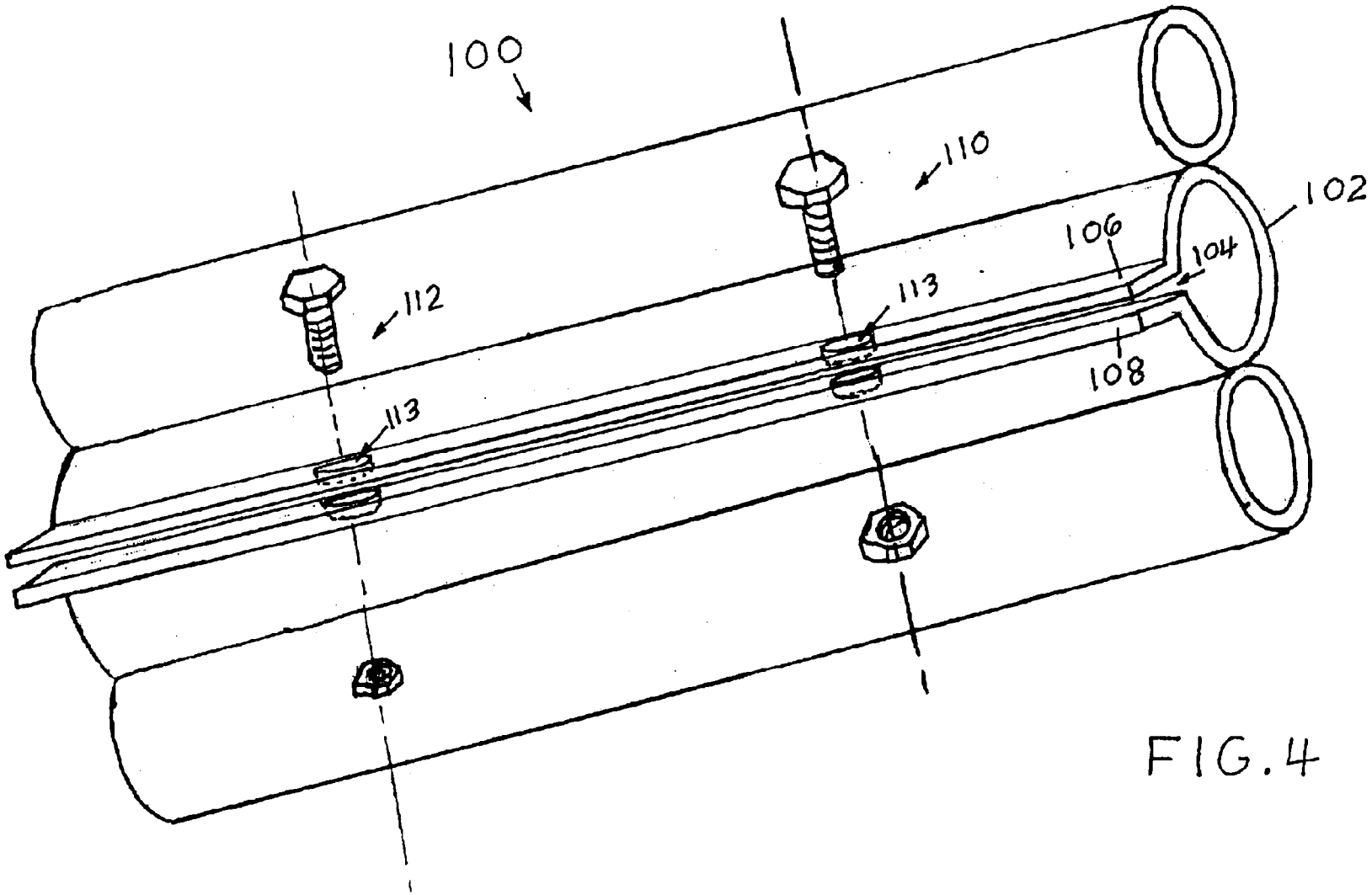
FIG. 4 shows apparatus for clamping a slotted center tube of a support apparatus to a backstay.

FIG. 4 shows an alternative apparatus for securing a three channel support apparatus 100 to a backstay. The center tube 102 has a slot 104 for pressing a backstay therethrough. In order to more securely grip the backstay in the tube 102, flanges 106 and 108 on opposite sides of the slot 104 are included for installing a nut and bolt pairs 110 and 112 and corresponding holes 113 in the flanges for forcing a degree of slot 104 closure, resulting in a reduced tube 102 diameter for securely gripping a backstay in the tube 102. Although continuous flanges are shown, the invention also includes any number and any spacing of separate flanges, and any number of spacing between flange holes 113. The present invention also includes other configurations of support apparatus for performing the functions of apparatus 100 that will be apparent to those skilled in the art upon reading the present disclosure. For example, the center tube 102 of FIG. 4 or 42 of FIG. 2A, could be replaced with a flat plate attached to outer tubes, and brackets of various designs can be used for securing the plate to a backstay. In further example, a slotted center tube could extend beyond the outer tubes on each end, allowing hose type clamps to be used to compress the tube and slot, and thereby grip the backstay.

Figure 5:
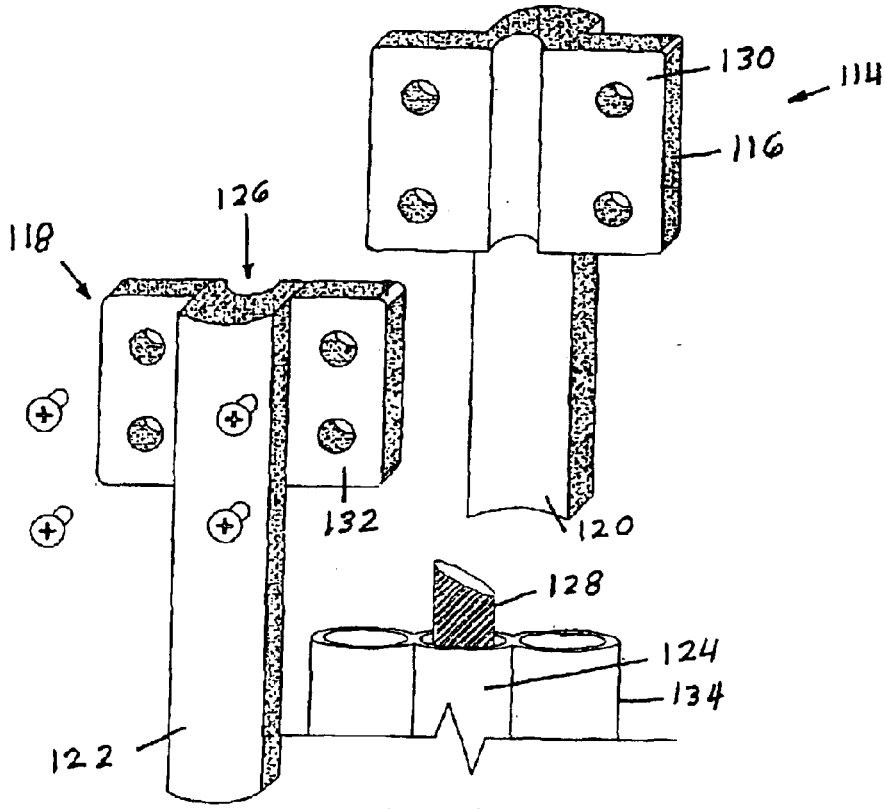
FIG. 5 shows a two-piece clamping apparatus for clamping a support apparatus to a backstay.

FIG. 5 shows another clamping apparatus 114 for clamping a center tube such as tube 42 of FIG. 2A to a backstay. The clamping apparatus is useful for installations where the center tube of the support apparatus is slit along its length to allow it to be pressed onto the support wire/backstay. The clamping apparatus 114 has two parts 116 and 118, for example constructed of plastic that are clamped tightly around a backstay, with one pair at the top and another at the bottom end of a support apparatus. Each two part clamp apparatus is positioned on the backstay so that the curved flanges, 120, 122 press down and grip the center tube. As illustrated, extensions 120 and 122 are positioned over the center tube 124. A reduced diameter 126 is configured for a tight fit around the backstay 128. The extensions 120 and 122 may be configured for an interference fit with the center tube 124, for applying a strong compressive force when flanges 130 and 132 are bolted together on the backstay.

Figure 6:
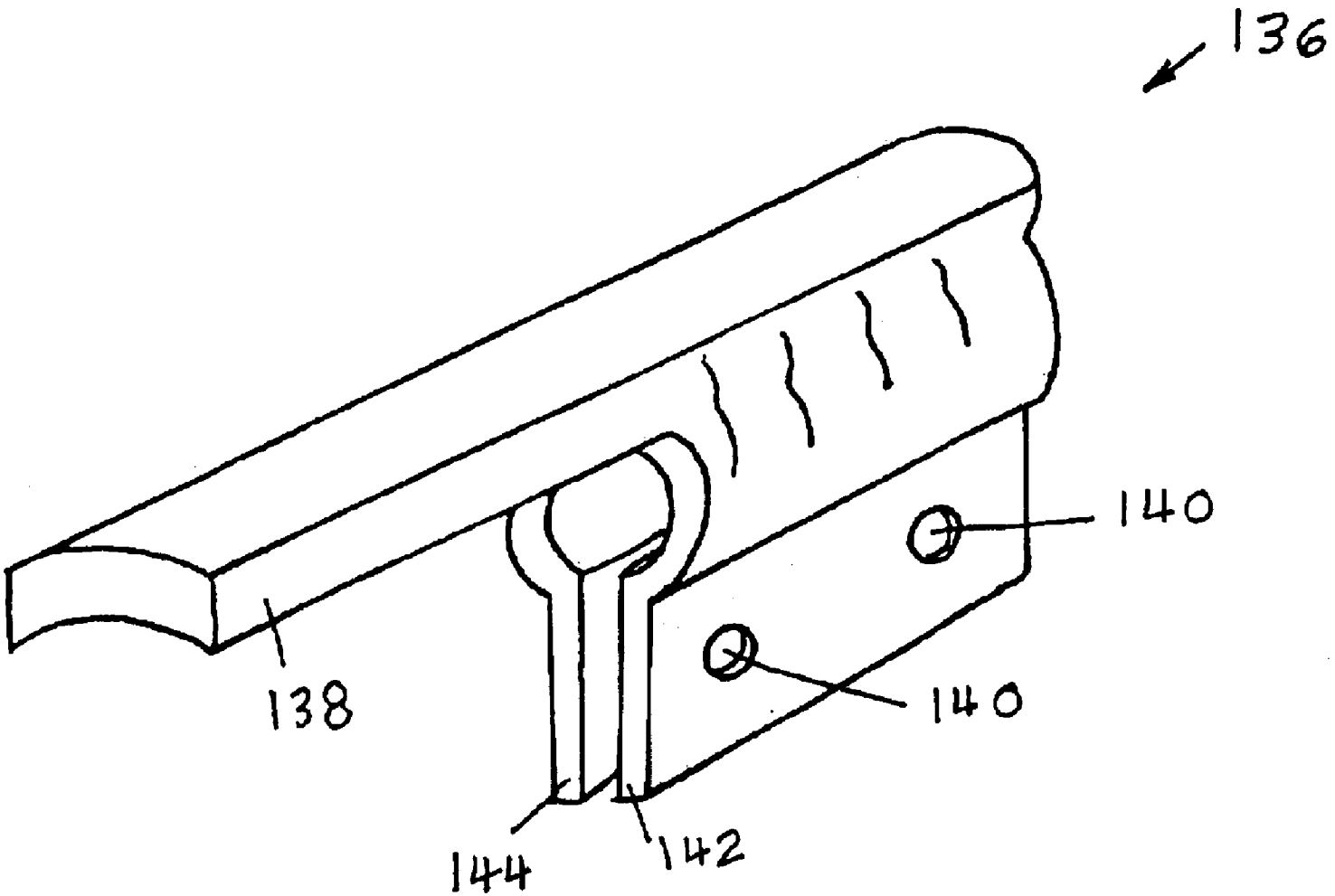
FIG. 6 shows a clamp for retaining a non-slotted center tube to a backstay.

An alternative clamping apparatus 136 is illustrated in FIG. 6. Apparatus 136 is useful where the center tube of a support apparatus is not slotted, for example as shown in FIG. 2B, and where the support wire/backstay does not have pre-existing swages or fittings. Two of the clamping apparatus 136 are used, including one for securing at the top of a support apparatus and a second for securing at the bottom of the support apparatus. In this example, the backstay must be disconnected, and both of the clamping apparatus 136 and the support apparatus are fed/slid onto the backstay. The flanges 138 then slide over the center tube at the top and bottom of the support apparatus, and grip the support wire/backstay by means of a nut and bolt arrangement through holes 140, pulling the two flanges 142 and 144 together and clamping the apparatus 136 to the backstay. Both clamping apparatus designs of FIGS. 5 and 6 can be produced inside a multi-cavity injection mold. They can be constructed either from Delrin or HDPE. The machined holes 140 can be dimensioned for #10-32 stainless steel fasteners.

Figure 7:
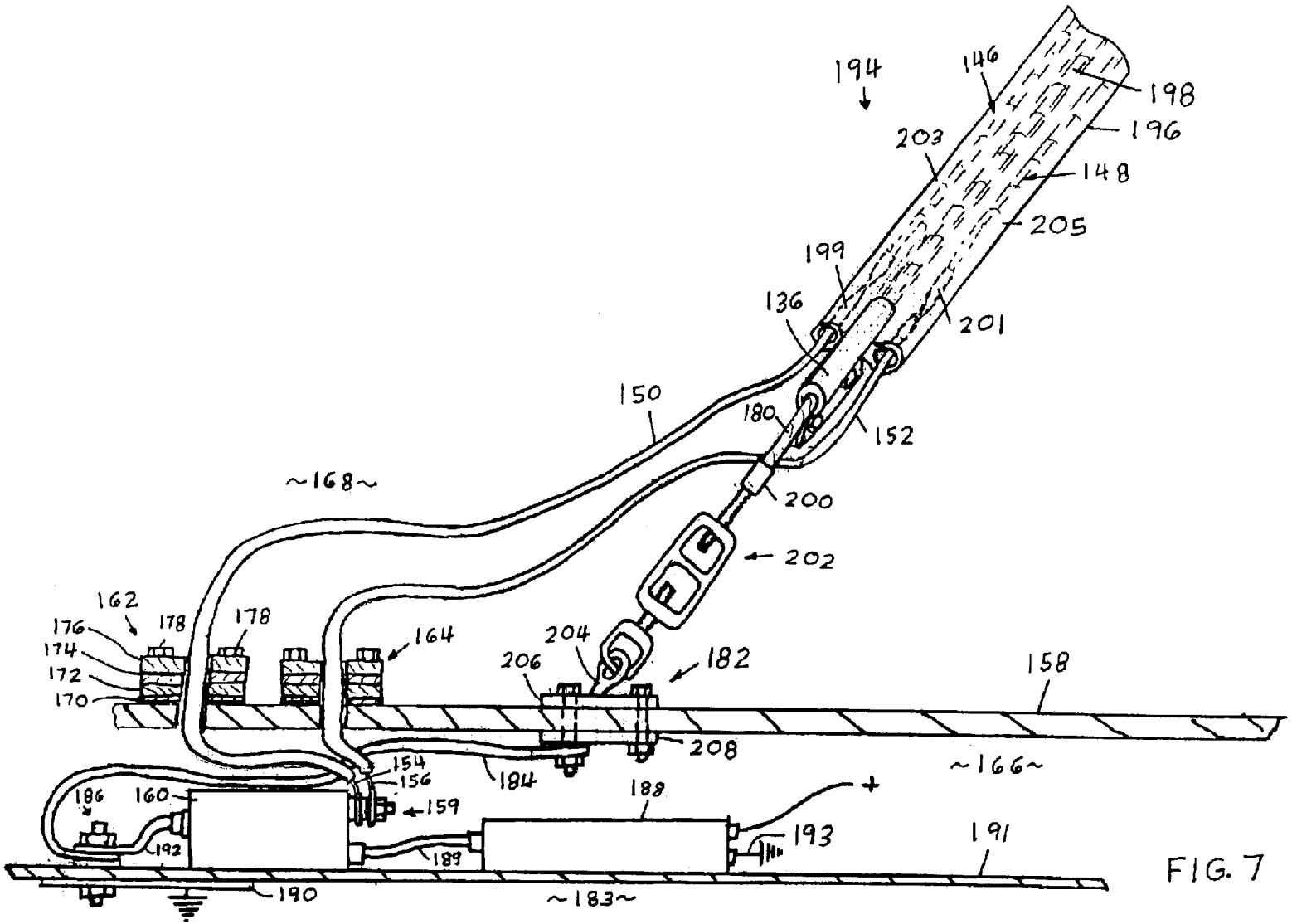
FIG. 7 shows use of a clamp, and ground connections.

FIG. 7 shows a further embodiment of the present invention wherein each of two radiators 146 and 148 are attached to lead-in wires/cables 150 and 152 respectively. Instead of joining the conductive elements 154 and 156 above the deck 158 of the boat, the elements 154 and 156 are joined in a weather protected area illustrated for example as area 166 below the deck 158 of the boat. With the elements 154 and 156 in a weather protected area, they can be joined together in any of various ways that will be apparent to those skilled in the art. FIG. 7 shows the elements 154 and 156 joined electrically at an antenna stud/terminal block 159 of an antenna tuner 160. The wires 150 and 152 are shown fed through the deck 158 of the boat by way of thru-deck-lands 162 and 164, which can be any type of feed-thru that seals so as to keep moisture from getting into the inside 166 from the outside 168. The thru-deck-lands 162 and 164 include a first seal 170 clamped to the deck with bolts/screws running through a plastic plate 172 into or through the deck 158. A flat flexible seal material 174 is placed between plate 172 and a top plate 176. The complete stack is then bolted to the deck with bolts 178, compressing the seal 174 and thereby causing it to expand laterally and apply pressure to seal the diameter of cable/wire 150.

The conductive backstay 180 is shown attached to the deck 158 through a mount 182. The particular embodiment of the mount 182 shown in FIG. 7 includes a rigging tong 204 and chain plate 206 welded together, and a backing plate 208. FIG. 7 also shows detail of the backstay mounting, including a swage/stud 200, and a rigging screw 202. As an alternative embodiment, the mount 182 provides an electrically conductive path from the conductive backstay 180 to a wire/cable 184 connected to a ground connection 186. The ground connection 186 can be any ground point that is common to the transceiver 188 and the tuner 160, but as shown, the ground of the antenna and transceiver system are connected to a ship "ground," indicated for example by a metal plate 190 on the outside of the ship hull 191 and therefore generally in contact with sea water 183. The tuner 160 is shown connected to a ground by wire 192 to the ground connection 186. The ground for the transceiver 188 can be accomplished in any of various ways that will be apparent to those skilled in the art, and is symbolically illustrated as line 193. The transceiver 188 input/output is connected to the tuner 160 by way of coax cable 189.

FIG. 7, for ease of illustration, only shows a lower portion of an antenna assembly 194. The antenna radiators 146 and 148, and three channel support apparatus 196 extend upward to a distal end similar to that shown in FIG. 2A, with apparatus for securing the distal ends of the radiators to the support apparatus 196, such as using plugs as shown in FIG. 2A. The support apparatus 196 may include a slotted or un-slotted center tube 198, and may have clamping apparatus such as clamp 136 shown, or other clamping apparatus at the top and/or bottom of the support apparatus 196. The clamping apparatus can also be used as an alternative embodiment to the above described antenna structures such as described in reference to FIG. 2A. Furthermore, the alternative use of common grounding of the backstay and tuner and transceiver, and connections to the boat ground also applies to the antenna structures described above as an alternative embodiment. FIG. 7 shows splices 199 and 201, such as splices 84 and 82 of FIG. 2A positioned inside the outer tubes 203 and 205, providing protection of the connections from moisture and other environmental conditions. Similarly, the splices 82 and 84 of FIG. 2A can be positioned inside tubes 44 and 46.

The following comments are provided for further explanation of the application and advantages of the present invention.

The split-lead antenna configurations as described above can either be slipped over an existing support wire/backstay, or "press fit" between existing wire swages and fittings that may be in place on a backstay. This greatly simplifies the installation of an antenna system, since the specialized wire-cutting and swaging skills and tools required for many prior art systems are not required with use of the antennas of the present invention. The split-lead system also enhances the mechanical integrity of the wire rope/backstay, since the wire is not longer interrupted by swages and plastic insulators along its length. The elimination of RF insulators is especially significant for sailboats. These vessels commonly use insulators in their backstay wires, which although relatively fragile, are critical to the support of the mast. The failure of an insulator or its swage could result in the damage or loss of the mast. For this reason, at least one major marine retailer has specified to its customers that "backstay insulators generally have a shorter lifespan than other rigging components, and should be checked regularly."

Wire-rope antenna elements on oceangoing sailboats that use the insulators in series to isolate the length of antenna from the remainder of the backstay, form an integral part of the vessel's standing rigging, and must accept potentially severe mechanical loads from the mast. In addition, the uninsulated wire-rope antenna elements generally used are directly exposed to rain, salt spray, etc., and must be highly corrosion resistant. For these reasons, wire-rope sailboat antennas are almost always made from stainless steel, which is not an optimum electrical conductor. Stainless steel is a relatively inefficient electrical conductor, possessing only about 3% of the electrical conductivity of copper. Indeed, wire rope antenna systems are designed to carry mechanical loads and no consideration is given to their current-carrying capacity. In contrast, the split-lead antenna radiator apparatus of the present invention receives no mechanical loads and is carefully shielded from the corrosive effects of rain, salt spray and moisture, which eliminates the need for the high tensile strength and corrosion resistance of stainless steel. These factors allow the split-lead antenna to use either tinned or silver-plated copper RF conductive elements, which are two of the most highly conductive materials available, while continuing to utilize an unbroken length of stainless steel wire-rope/backstay as a strong and relatively lightweight mechanical support.

The use of the split-lead antennas of the present invention, instead of the wire-rope antenna using series insulators, could prove significant to the U.S. Navy, which currently specifies 5/16" diameter phosphor bronze for its wire-rope antenna systems. Phosphor bronze is specified due to its superior conductivity relative to stainless steel, in spite of the fact that stainless steel possesses a breaking strength nearly three and a half times as great. By switching to a split-lead antenna, a stainless steel support wire could be specified in place of phosphor bronze, increasing mechanical strength by a factor of 3.5:1 and electrical conductivity by a factor of 10:1 over phosphor bronze.

Wind-blown precipitation (snow, rain, sleet, etc.) impacting a bare wire-rope antenna causes a form of natural interference called precipitation static. This static is greatly reduced when the wire rope is jacketed with an insulating material. However, jacketing a conventional wire antenna is problematic in a marine environment, since doing so tends to increase the rate of corrosion on the wire. This increased rate of corrosion is caused by water, often mixed with salt and corrosive exhaust residue, wicking its way between the insulating jacket and the wire rope itself. Under these conditions, even "non corrosive" metals such as phosphor bronze and stainless steel can rapidly corrode. In the 1980s, for example, the United States Navy jacketed its phosphor-bronze wire rope antennas with vinyl to try to reduce precipitation static. Static was reduced, but the corrosion rate of the wire-rope radiators was increased to an unacceptable degree. The water's point of entry occurred at the top and bottom ends of the antenna and wherever the vinyl jacketing was terminated, for example at in-line voltage insulators, connectors, etc. Since the wire-rope receives constant mechanical stresses from the vessel, any kind of sealant placed at these termination points eventually cracks open and allows water ingress and subsequent rapid corrosion of the jacketed phosphor-bronze antenna wires.

Unlike the Navy antennas described above, the split-lead antenna radiator apparatus of the present invention is housed within oversized HDPE plastic tubes. The tubes are capped and sealed at the top and these seals are not subject to mechanical stresses that might otherwise compromise their watertight integrity. The tubes are left open at the bottom to allow any water condensation or leakage that does occur to drain out through full-length water drainage channels. This design shields the RF radiators from precipitation static and potential shorts to ground while minimizing the corrosion associated with conventional wire jacketing.

Because the RF radiator apparatus on the split-lead antenna are each housed in separate tubes, they can easily be connected to an antenna lead-in wire by means of an electrical Y-splice and heat-shrinkable tubing. The connections are simple and watertight. This arrangement is in contrast to the HF antenna/lead wire connections found on most sailboats, where the lead-wire jacket is simply stripped and bare copper wire is wrapped around a backstay wire. A few servings of electrical tape are then applied, often followed by a hose clamp. Understandably, these connections represent one of the most common sources of corrosion-induced RF current loss aboard sailboats.

Another advantage of the split-lead antenna of the present invention is that it can easily be removed and slipped onto a new wire. Its various components can also be removed and replaced as necessary. In contrast, swaged RF in-time insulators form a permanent part of the wire rope/backstay to which they are attached and are therefore not easily replaced.

Conventional wire rope antennas, with their exposed radiators, pose a high voltage shock hazard. This hazard is potentially severe aboard sailboats, where boat motion can be considerable and insulated backstays often serve as handholds. Since the split-lead antenna radiators are encased in plastic tubing, there is no potential shock hazard posed by touching the antenna element during tune-up or transmission.

While a particular embodiment of the present invention has been shown and described, it will be obvious to those skilled in the art that changes and modifications may be made without departing from the spirit of the present invention, and therefore the appended claims are to include these changes and alterations as follow within the true spirit and scope of the present invention.

What is claimed is:

1. An antenna assembly comprising:

a single antenna including a single radiator element having i) a first elongated radiator apparatus containing a first electrically conductive element having a proximal end;

ii) a second elongated radiator apparatus containing a second electrically conductive element having a proximal end, said second apparatus positioned in a juxtaposed orientation to said first radiator apparatus: and wherein said proximal ends of said first and second elements are to be interconnected electrically in operation; and iii) a support apparatus for holding a substantial length of said first radiator apparatus and said second radiator apparatus juxtaposed and laterally spaced apart, and said support apparatus configured for mounting on a conductive backstay positioned substantially parallel to and equidistance from said first and second radiator apparatus.

2. An assembly as recited in claim 1 wherein said proximal ends are connected at a junction for connecting to a lead-in wire.

3. An assembly as recited in claim 1 wherein said proximal end of said first element is connected at a first connection to a first lead-in wire, and said proximal end of said second element is connected at a second connection to a second lead-in wire.

4. An assembly as recited in claim 3 wherein said first and second connections are inside said support apparatus.

5. An assembly as recited in clam 1 wherein said support apparatus includes a center tube in which said backstay is positioned upon installation of said antenna assembly.

6. An assembly as recited in claim 1 wherein said support apparatus includes first and second outer tubes spaced apart, and said first and second outer tubes are for containing said first radiator apparatus and said second radiator apparatus respectively.

7. An assembly as recited in claim 5 wherein said support apparatus further includes first and second outer tubes attached to and spaced apart by said center tube, and said first and second outer tubes are for containing said first and second radiator apparatus respectively.

8. An assembly as recited in claim 7 further comprising first and second retaining apparatus for retaining a distal end of corresponding said first and second radiator apparatus proximate a distal end of said first and second outer tubes respectively.

9. An assembly as recited in claim 8 wherein said first and second retaining apparatus include first and second plugs respectively, wherein each said plug has an eyelet for attachment of a said conductive element for retaining a corresponding said radiator apparatus.

10. As assembly as recited in claim 5 wherein said center tube includes a slot through a wall of said center tube, extending a length of said center tube, wherein said slot is for passing a backstay therethrough into said center tube.

11. An assembly as recited in claim 1 further comprising clamping apparatus for clamping said support apparatus to a mainstay.

12. An assembly as recited in claim 5 wherein said first and second outer tubes include a water drain channel.

13. An assembly as recited in claim 3 wherein proximal ends of said lead-in wires are electrically connected at a connection.

14. An assembly as recited in claim 13 said connection is in a weather protected environment.

15. An assembly as recited in claim 14 wherein said lead-in wires each pass through a feed-thru into an interior of a boat having said connection therein.

16. An assembly as recited in claim 11 wherein said clamping apparatus includes a first clamp apparatus at a proximal end of said support apparatus, and a second clamp apparatus at a distal end of said support apparatus.

17. An assembly as recited in claim 16 wherein each said first and second clamp apparatus clamps directly to said mainstay and to a center tube of said support apparatus.

18. An assembly as recited in claim 11 wherein said support apparatus includes a slotted center tube through which said mainstay is placed, and wherein said center tube includes a flange on each side of said slot with bolt holes through said flanges for insertion of bolts for compressing said flanges together to cause said tube to grip said mainstay.

19. An antenna assembly comprising:

a single antenna including a) a first elongated radiator apparatus containing a first electrically conductive element;

b) a second elongated radiator apparatus containing a second electrically conductive element electrically connected to said first conductive element, said second apparatus positioned in a juxtaposed orientation to said first radiator apparatus; and c) a support apparatus for holding a substantial length of said first radiator apparatus and said second radiator apparatus juxtaposed and laterally spaced apart, and said support apparatus and said second radiator apparatus juxtaposed and laterally spaced apart, and said support apparatus configured for mounting on a conductive backstay positioned substantially parallel to and equidistance from said first and second radiator apparatus, and wherein in operation said conductive backstay is to be grounded.

* * * * *